US007252203B2

(12) United States Patent
Frankenberger et al.

(10) Patent No.: US 7,252,203 B2
(45) Date of Patent: Aug. 7, 2007

(54) MOBILE CRANE HAVING A SUPERLIFT DEVICE

(75) Inventors: Ralf Frankenberger, Kaiserslautern (DE); Jörg Lattwein, Dillingen (DE); Manfred Kretschmer, Hilden (DE)

(73) Assignee: Terex-Demag GmbH & Co. KG, Zweibruecken (DE)

( * ) Notice: Subject to any disclaimer, the term of this patent is extended or adjusted under 35 U.S.C. 154(b) by 463 days.

(21) Appl. No.: 10/494,726

(22) PCT Filed: Sep. 20, 2002

(86) PCT No.: PCT/DE02/03640

§ 371 (c)(1),
(2), (4) Date: May 6, 2004

(87) PCT Pub. No.: WO03/040016

PCT Pub. Date: May 15, 2003

(65) Prior Publication Data

US 2005/0098520 A1 May 12, 2005

(30) Foreign Application Priority Data

Nov. 6, 2001 (DE) ..... 101 55 006

(51) Int. Cl.
*B66C 13/18* (2006.01)

(52) U.S. Cl. ..... 212/279; 212/27

(58) Field of Classification Search ..... 212/279, 212/278

See application file for complete search history.

(56) References Cited

U.S. PATENT DOCUMENTS 5,005,714 A * 4/1991 Kroll et al. ..... 212/196
5,257,177 A * 10/1993 Bach et al. ..... 700/61
5,730,305 A * 3/1998 Ichiba et al. ..... 212/276
5,731,974 A * 3/1998 Pietzsch et al. ..... 700/83
6,568,547 B1 5/2003 Kretschmer et al.
6,744,372 B1 * 6/2004 Shaw et al. ..... 340/685
2002/0015062 A1 * 2/2002 Shimazu et al. ..... 345/772

FOREIGN PATENT DOCUMENTS

DE 198 57 779 A1 6/2000

(Continued)

*Primary Examiner*—Thomas J. Brahan
(74) *Attorney, Agent, or Firm*—Cohen Pontani Lieberman & Pavane LLP

(57) ABSTRACT

A mobile crane with a carrier and a superstructure which is slewably arranged thereon has a superlift device with an SL counterweight for increasing lifting capacity. The SL counterweight can be lifted from the ground in order to execute slewing movements of the superstructure and its slewing radius is changeable. The crane has an electronic control device with a computing device and with a display. In order to avoid costly conversion work on the SL counterweight and to increase operating safety, a program is stored in the electronic control device, which program determines a permissible operating field for crane parameters from the parameters comprising load size and load radius, size of SL counterweight and SL counterweight radius while taking into account the stability criteria and capacity criteria of the mobile crane and displays this operating field graphically on the display. Within this operating field, these parameters may be safely changed, the rest of the parameters remaining constant, and the lifting of the SL counterweight from the ground can be ensured.

16 Claims, 3 Drawing Sheets

FOREIGN PATENT DOCUMENTS

| | | |
|---|---|---|
| DE | 199 31302 A1 | 1/2001 |
| DE | 202 03 686 U1 | 7/2002 |
| GB | 2 353 514 | 2/2001 |
| JP | 7081887 | 3/1995 |
| JP | 9328296 | 12/1997 |
| JP | 2000044177 | 2/2000 |

* cited by examiner

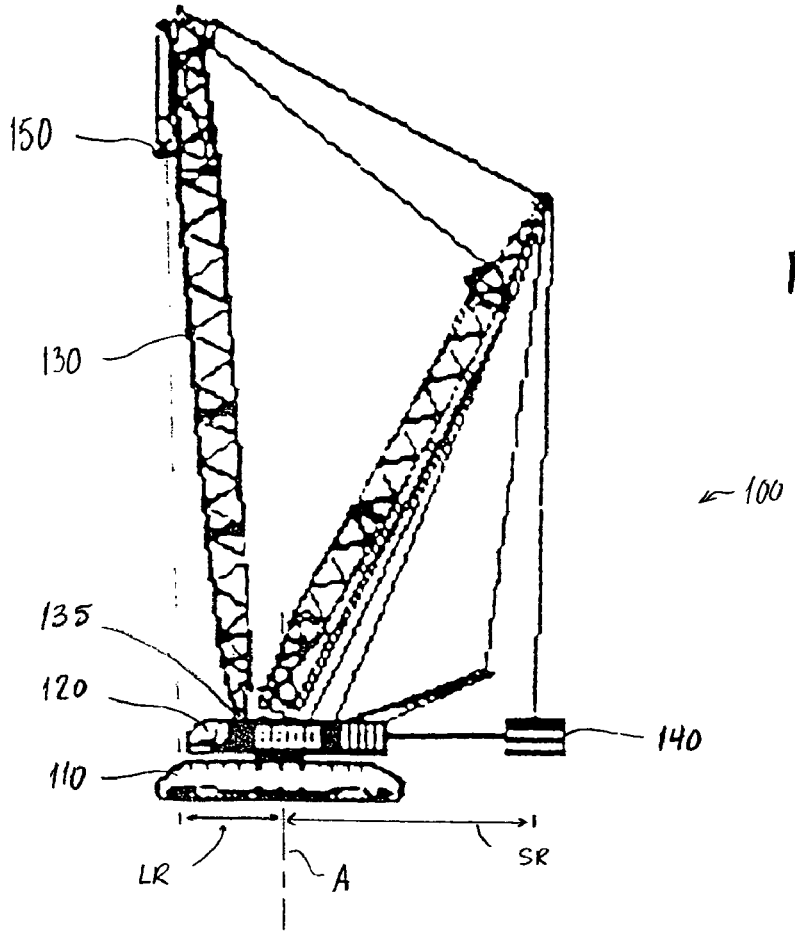
Fig. 3
Fig. 4
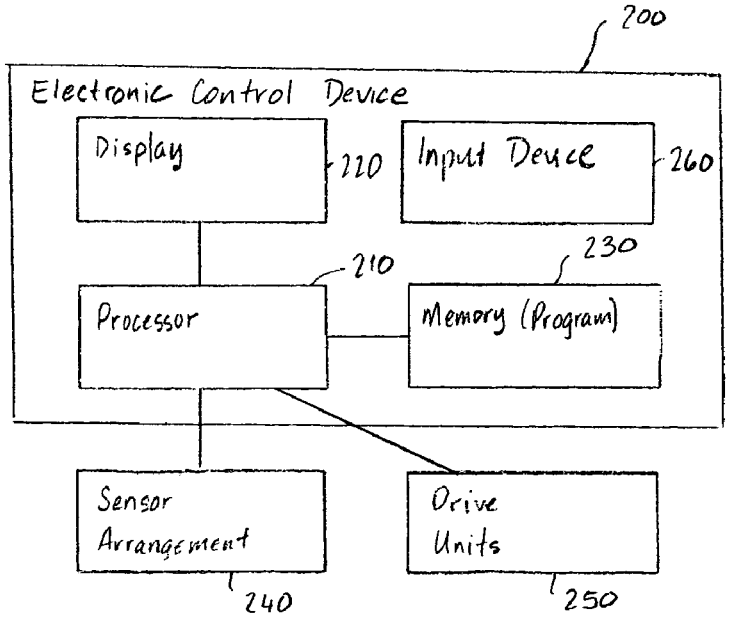

MOBILE CRANE HAVING A SUPERLIFT DEVICE

PRIORITY CLAIM

This is a U.S. national stage of application No. PCT/DE02/03640, filed on 20 Sep. 2002. Priority is claimed on that application and on the following application(s): Country: Germany, Application No.: 101 55 006.5, Filed: 06 Nov. 2001.

BACKGROUND OF THE INVENTION

1. Field of the Invention

The invention is directed to a mobile crane with a carrier and a superstructure arranged thereon so as to be slewable around a vertical axis, a boom device for lifting a load which is articulated at the superstructure and swivelable around a horizontal axis, and a counterweight arrangement constructed as a superlift device which increases lifting capacity and which is connected to the superstructure in such a way that the counterweight of the superlift device (SL counterweight) can be lifted from the ground to execute slewing movements of the superstructure, wherein the slewing radius of the SL counterweight is changeable, and with an electronic control device for actuating drive units of the mobile crane which is provided with a computing device and with a display and input device for the mobile crane operator for entering data.

2. Description of the Prior Art

Mobile cranes of the type mentioned above are often provided with a crawler chassis and can have a luffing lattice boom. The inclination of the boom can be changed continuously by means of a mast that is arranged at the superstructure in the luffing plane so as to be inclined toward the rear and by rope guying arranged at the mast. The superstructure is normally outfitted with a counterweight. In order to increase lifting capacity, additional ballast can be suspended by the mast in the form of a superlift device as a counterweight to the load to be lifted (SL counterweight). The SL counterweight can be arranged, for example, on a crossarm or on a counterweight carrier which is suspended at the mast by means of a corresponding rope suspension. The horizontal distance between the axis of rotation of the superstructure and the center of gravity of the SL counterweight is referred to as the SL counterweight radius. This applies in a corresponding sense to the term "load radius" as regards the load suspended from the mobile crane. When the superstructure of the mobile crane must execute slewing movements around its vertical axis of rotation with suspended SL counterweight, the counterweight carrier can often follow the slewing movement by controlling the chassis of the counterweight carrier in a corresponding manner. However, this is no longer possible when there are obstacles on the ground within the slewing area. In such cases, just as when the SL counterweight is arranged on a crossarm, the possibility of lifting the SL counterweight off the ground must be ensured under the load conditions of the lifting task at hand without jeopardizing the stability criteria (e.g., standing stability, strength of structural component parts) and the capacity criteria (e.g., rope limits).

When a lifting task is to be performed, the load radius when picking up a load is generally different than the load radius when setting down this load. Accordingly, the load moment sometimes changes considerably during a lifting task. The counterweight moment used for compensating must take this into account and must often be changed when performing a lifting task because, e.g., in case of a substantially reduced load radius, the counterweight moment of the SL counterweight is so overbalanced that it is no longer possible to lift the counterweight to enable slewing movements of the superstructure for reasons of stability. It may be necessary in such cases, for example, to reduce the SL counterweight. However, this entails substantial conversion work. It is often even sufficient to adapt the effective counterweight radius to the changed conditions. The SL counterweight is frequently connected to the superstructure by a telescoping rod which extends essentially horizontally or at least flatly and can be changed in length, for example, by a hydraulic cylinder. By retracting or extending the telescoping rod, the SL counterweight can be adjusted to a smaller or greater radius so that a counterweight moment can be adjusted at which the SL counterweight, which is usually on the order of about 30 cm from the ground, can be lifted without difficulty under the actual load moment.

Since the transport of counterweights is cumbersome and expensive, it is generally desirable to transport as little counterweight as possible to the site where the mobile crane is being used. On the other hand, there is often considerable uncertainty about the actual order of magnitude of the load to be lifted. For example, in the case of a processing installation that has been removed from operation, its actual weight may be considerably greater than the earlier, exactly known assembled weight due to the addition of production remainders in the installation. Therefore, corresponding uncertainties must be taken into account when possible in preparing for a lifting task. A planning task of this kind requires great care and consideration of extensive lifting capacity tables just as much as in the actual performance of the lifting task which may require multiple changes in load radius and counterweight radius due to obstacles in the area of the construction site. Because of the substantial risk potential in transporting heavy loads, the safety aspect takes on a very particular significance.

SUMMARY OF THE INVENTION

It is the object of the present invention to improve a mobile crane of the type mentioned above in such a way that lifting tasks for the crane can be carried out with a minimum of conversion and the smallest possible counterweight to be carried along while providing great security for the crane operator.

According to the invention, a program stored in the electronic control device determines an operating field for crane parameters from the parameters comprising load size and load radius, size of SL counterweight and SL counterweight radius while taking into account the stability criteria and capacity criteria of the mobile crane and displays this operating field graphically on the display for the crane operator who can use this to carry out the pending lifting task. The operating field has an upper limit and a lower limit within which the respective parameters that are displayed graphically can be safely changed while the rest of the parameters remain constant. In so doing, it is ensured that the SL counterweight can be lifted from the ground at any time. In addition, the actual quantity of the graphically displayed parameters can be displayed within the operating field during the ongoing crane operation. This can be realized basically through numerical displays, for example. However, the actual parameter values are preferably displayed graphically. In particular, it can be advantageous when the actual quantity of the parameters from the ongoing crane operation is shown through a crosshair. This is recommended primarily when, in an advantageous further development of the invention, the limits of the operating field are displayed by lines, particularly lines of different form and/or color. Alternatively, an operating field could also be represented, for example, by bar graphs. A graphic display has the great advantage over the display of pure numerical values that it can be grasped intuitively and therefore very quickly and reliably by the crane operator.

With respect to the graphic display of the actual value of the parameters from the ongoing crane operation, it can be provided that this display is carried out only when required by the crane operator. It is much more reliable and is preferable within the framework of the invention that this display is carried out continuously automatically. This means that the actual operating parameters of the mobile crane which correspond to the operating field are automatically tracked on the display. Therefore, the crane operator can always be certain about the precise point in the operating field at which the crane is located so that the crane operator can always view the actual spectrum within which the crane can be handled.

The load radius and the counterweight radius are advisably graphically displayed as parameters of the operating field. Accordingly, in a preferred further development of the invention, the electronic control device of the mobile crane is connected by signal engineering to a sensor arrangement for determining the actual adjusted load radius and the adjusted SL counterweight radius. In this context, it is particularly advantageous when the mobile crane has a mechanical adjusting device for the SL counterweight radius which can be actuated by the crane operator.

Further, it is advisable to provide a measuring device for determining the actual magnitude of the load to be suspended at the mobile crane and to connect this measuring device by signal engineering to the electronic control device. Of course, it is possible in principle to determine the load quantity separately instead and to enter this quantity manually using the input device of the electronic control device, for example. However, this is not preferable due to the manual effort required and also because of the increased risk of error.

In order to further improve operating reliability, the electronic control device can be connected by signal engineering to a measuring device which displays a value for the load change in the mobile crane brought about by the effect of wind, so that the control device can take this value into account when determining the permissible operating field.

The operating mode of the electronic control device can preferably be switched to a planning mode in which the different load states of the crane can be simulated for preparing the operating sequence of a specific lifting task. In this way, it is possible for the crane operator to investigate beforehand the specific settings among various parameter adjustments that are particularly favorable for minimizing total expenditure. It is highly advantageous when not only the above-mentioned operating field for the parameters comprising load radius and SL counterweight radius but also a graph of the permissible upper limit and lower limit of permissible load can also be displayed in the planning mode at a given load radius and a given quantity of the SL counterweight depending on the SL counterweight radius.

BRIEF DESCRIPTION OF THE DRAWINGS

The invention will be described more fully in the following with reference to the embodiment example shown in the drawings.

FIG. 3 is a schematic side view of a mobile crane assording to the present invention; and FIG. 4 is a block diagram of an electronic control device of the mobile crane of FIG. 3.

DETAILED DESCRIPTION OF THE PREFERRED EMBODIMENTS

Figure 1:
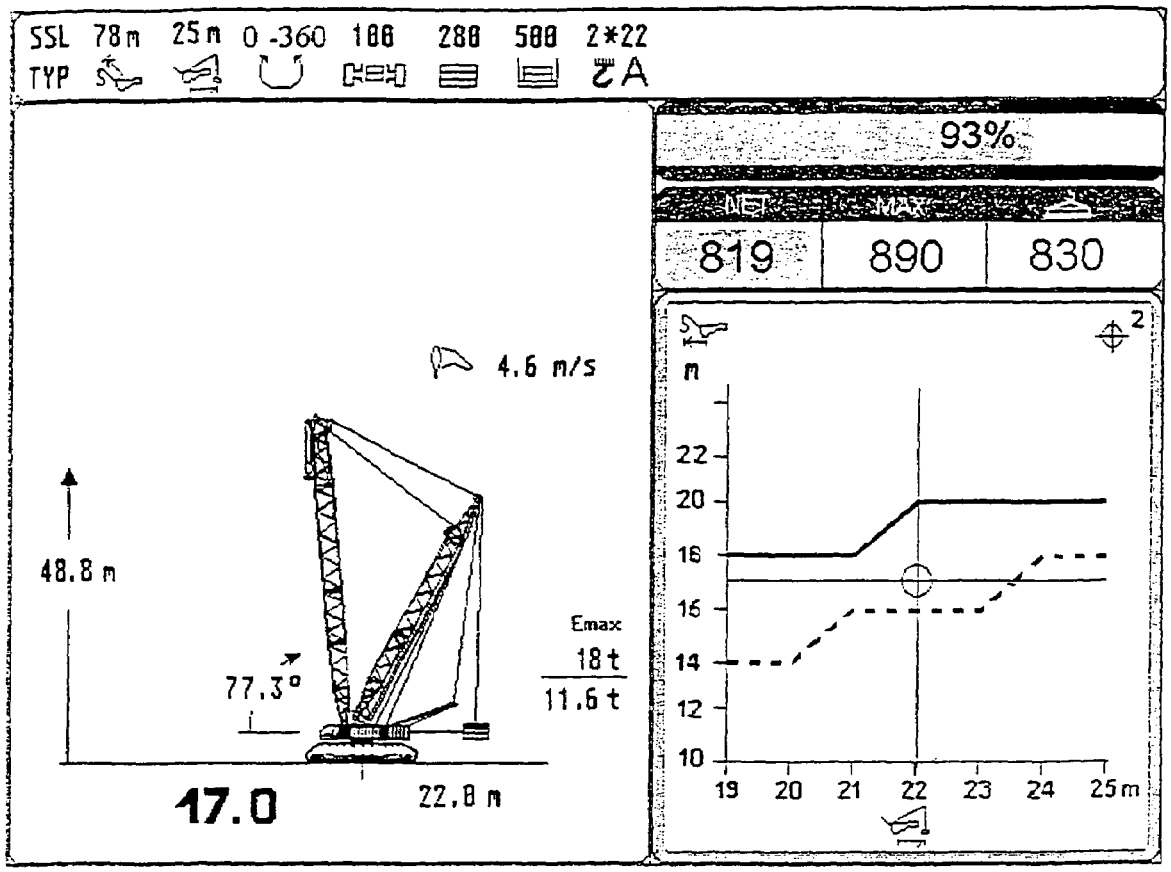
FIG. 1 shows a display in the operating mode.

A mobile crane 100 according to the present invention is shown in FIG. 3. The mobile crane 100 includes a carrier 110 and a super structure 120 arranged thereon so that the superstructure is slewable about a vertical axis A. A boom 130 for lifting a load is articulated at the superstructure and swivelable about a horizontal axis 135. A counterweight arrangement 140 constructed as a superlift device increases the lifting capacity. The counterweight of the superlift device (hereafter referred to as SL counterweight 140) can be lifted from the ground to execute slewing movements of the superstructure. A slewing radius SR of the SL counterweight 140 is adjustable.

The mobile crane also has an electronic control device 200 shown in FIG. 4. The electronic control device 200 includes a computer device or processor 220, an input device 260, and a memory 230. The electronic control device is connected to a sensor arrangement 240 for determining crane parameters and drive units 250 of the mobile crane. The memory 230 of the electronic control device 200 includes a program for determining an operating field for crane parameters from the parameters comprising load size, load radius, size of the SL counterweight and SL counterweight radius, while accounting for stability criteria and capacity of the mobile crane.

The display 220 of the control device of a mobile crane according to the invention is divided into a plurality of areas in FIG. 1. It has a narrow upper parameter strip showing settings of essential parameters of the mobile crane. These parameters which are displayed numerically have symbols explaining their meaning and are therefore easy to understand. In the present case, for example, a superlift device is indicated as the crane type, a boom length of 78 m is indicated, and a maximum SL counterweight radius of 25 m is indicated. The indicated slewing area of the crane is 360°. The central ballast is 100 t, the counterweight of the superstructure is 280 t and the total suspended SL counterweight is 500 t. The hook block of the crane has a rope reeving of 2×22. The left-hand portion of the screen display shows in symbols a mobile crane with suspended SL counterweight raised from the ground. Since the mobile crane has a sensor arrangement 240 for determining the current adjustment of the boom inclination, the corresponding luffing angle can be displayed. In the present case, it is shown as a numerical value of 77.3°. At this inclination, there is a load radius of 17.0 m which is displayed as an especially large-sized, bold numerical value. The associated possible hook height is 48.8 m and is indicated at the left-hand edge. The current SL counterweight radius of 22.0 m is likewise displayed as a numerical value at the lower edge on the left-hand side of the drawing. The maximum hoisting power of 18 t for the luffing gear for adjusting the boom inclination is shown by $E_{max}$ in the numerical display on the right-hand side of the illustration of the mobile crane; exactly 11.6 t of this maximum hoisting power is actually being used taking into account the suspended load. The current wind speed of 4.6 m/s is indicated above the illustration of the crane by a windsock symbol.

The suspended load and the load which can be suspended is indicated at the top on the right-hand side of the drawing. The load that is actually suspended is indicated as 830 t which corresponds to a net load of 819 t in the present example. The latter numerical value has a colored background. In addition, the quantity of the maximum permissible suspended load is indicated as 890 t. Above these numerical values, the extent of the maximum permissible load being used up by the actually suspended load is indicated in the form of a bar graph and as a numerical value of 93%. In the bottom portion of the right half of the drawing, the operating field, according to the invention, for the two parameters comprising SL counterweight (abscissa) and load radius (ordinate) is shown. The two radii are indicated in meters. The meaning of the axes of the coordinate system is illustrated by corresponding crane symbols. The bottom, dashed line shows the minimum value of the load radius that must be achieved, depending on the adjusted SL counterweight radius, to ensure that the SL counterweight is raised from the ground. When this lower limit shown in dashes is not reached, the SL counterweight is set on the ground so that the superstructure can no longer swivel. The solid, bold line on top indicates the permissible upper limit for the load radius depending on the SL counterweight radius under the adjusted conditions (SL counterweight of 500 t and suspended load of 830 t). The operating field for the crane under the given parameter settings in which SL counterweight radius and load radius can vary without risk is shown between the solid line and the dashed line. The actual setting of these two parameters is made easily visible by a crosshair with an additional small circle. The quantity of the counterweight radius of 22 m and the quantity of the load radius of 17 m, which are also shown numerically at the lower edge of the screen on the left, can be discerned.

Therefore, the crane driver intuitively discerns in the present example that the SL counterweight radius can easily be changed within the range of 19 m to about 23.5 m while maintaining the load radius of 17 m when carrying out slewing movements to avoid any obstacles in the slewing area of the SL counterweight. Conversely, the load radius could be changed without risk between 16 m and 20 m while maintaining a constant SL counterweight radius of 22 m. If the load radius were to be increased to over 20 m and there was therefore a risk of exceeding the stability criteria or capacity criteria, the drive for adjusting the boom inclination would be switched off automatically in an advantageous further development of the invention so that the operating parameters would remain on the safe side in every case.

Figure 2:
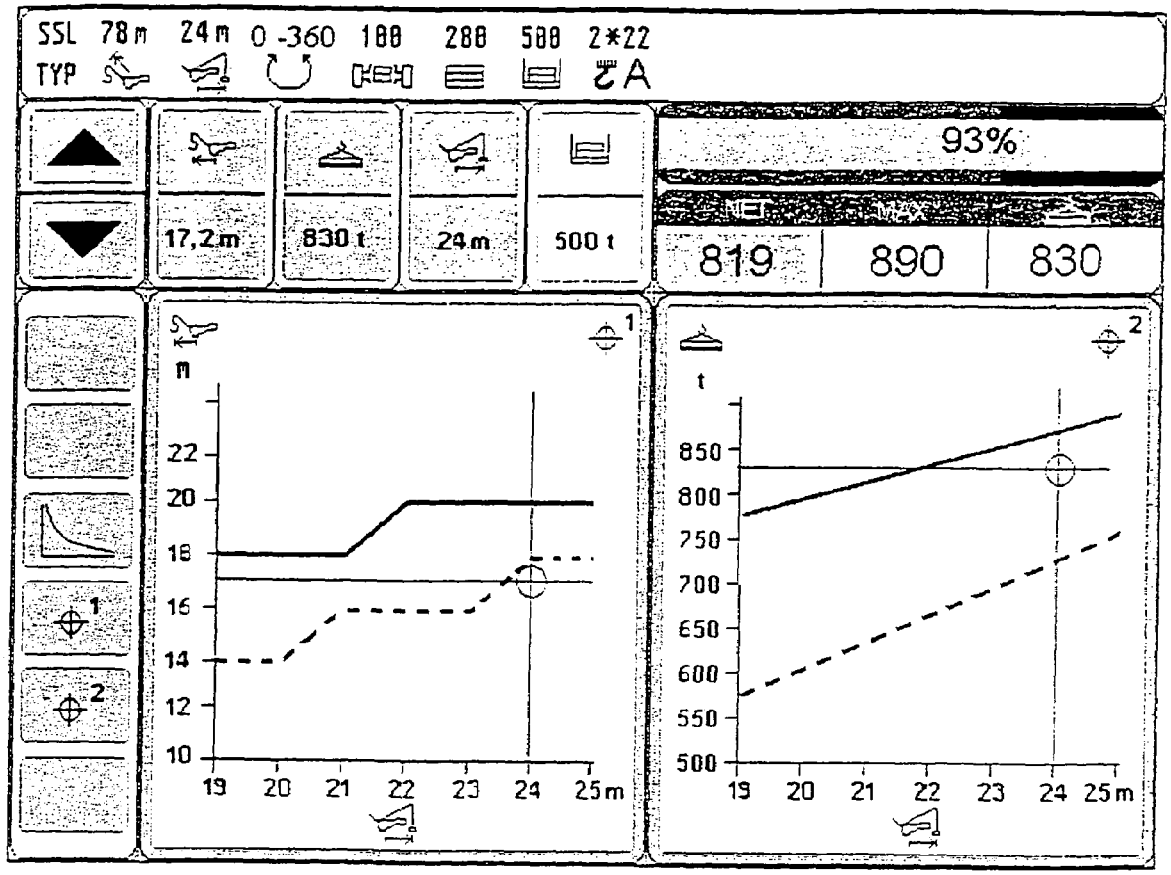
FIG. 2 shows a display in the planning mode.

The screen display in the planning mode is shown in FIG. 2. It will be seen that in an advantageous further development of the invention the display is constructed as a touch screen and therefore serves not only as a display unit but also as an input device for entering data. By selecting corresponding symbols for the maximum desired load radius (20 m), the suspended load (830 t), the starting value of the SL counterweight radius set for planning (24 m) and the provided SL counterweight (500 t), the respective parameter values can be adjusted by operating the two buttons on the left, identified by corresponding black arrows, for increasing or decreasing the indicated values. The graph in the lower left-hand part of the drawing corresponds to the graph for the permissible operating field shown in FIG. 1. In the present case, however, a combination of parameters lying outside of the permissible operating field is provided in the planning phase for the SL counterweight radius and the load radius so that the SL counterweight is placed on the ground and no slewing of the superstructure would be possible. If this combination of radii were absolutely necessary due to the conditions at the planned construction site, it would be necessary to change the size of the SL counterweight. Therefore, this could be safely detected already in the planning phase without substantial expenditure.

The dependency of the permissible suspended load upon the adjusted SL counterweight radius is shown again on the right-hand side of FIG. 2 in the form of an operating field with a solid line for the upper limit and a dashed line for the lower limit. Accordingly, the crane operator can easily see the remaining limits within which to maneuver for the load that can actually be suspended at corrected values of the SL counterweight radius. When needed, the crane operator can change the parameter combination by simply pressing a button and can immediately detect any improvement or, in case of erroneous input, worsening of the desired margins for the respective lifting task.

The mobile crane operator's work is considerably facilitated and made safer through the present invention. Costly examination of extensive lifting capacity tables along with the possibility of incorrect reading is completely eliminated. Since a fast, error-free simulation of all essential parameters of a lifting task can be carried out already in the planning phase, it is easily possible to limit the size of the counterweight to be transported to the construction site to a minimum. As a rule, costly conversion of the counterweight at the construction site during the lifting operation can be avoided in this way. Since critical parameter combinations can be detected through the control device of the mobile crane, dangerous impermissible combinations of parameters are eliminated. The available leeway for changing the two crane parameters comprising load radius and SL counterweight radius in particular can easily be discerned by the crane operator intuitively. The expenditure undertaken with respect to apparatus for this purpose is minor.

A special advantage of the invention consists in that the crane operator can immediately detect at any point in time the extent to which a critical limit has already been approximated. Unstable states can occur in that the load radius changes to an impermissible value, for example, due to a pendulum motion of the load under the influence of the wind load. As a result, for example, the SL counterweight can suddenly be set upon the ground so that a slewing movement of the superstructure taking place at the moment would suddenly be interrupted. This can result in especially dangerous situations. Due to the fact that the crane operator can easily see the actual position of the operating parameters within the operating field at any time because of the construction of the control device according to the invention, the crane operator can safely avoid critical proximity to the boundary areas from the start.

What is claimed is:

1. A mobile crane, comprising:

a carrier;

a superstructure arranged on said carrier such that said superstructure is rotatable about a substantially vertical axis;

a boom device for lifting a load, said boom device being articulated at said superstructure and swivelable about a horizontal axis;

a counterweight arrangement comprising a counterweight for increasing a lifting capacity of said mobile crane, said counterweight arrangement being connected to said superstructure such that said counterweight is liftable from the ground for allowing said counterweight to follow slewing movements of said superstructure, wherein a slewing radius of said counterweight is adjustable;

actuating drive units for rotating said superstructure, adjusting said boom device, and adjusting the slewing radius of said counterweight;

a sensor arrangement for determining crane parameters; and an electronic control device having a processor connected to a display and an input device for the mobile crane operator to input data, and a memory device connected to said processor and storing a program, said program including computer-executable instructions for determining an operating field for a display parameter selected from the group of display parameters consisting of load size, load radius, size of said counterweight and slewing radius of said counterweight and displaying the determined operating field on said display, the operating field includes an upper limit and a lower limit defining an adjustable range of the selected display parameter in which said counterweight is safely liftable from the ground while the remaining display parameters remain constant, said program further comprising instructions for determining and displaying actual quantities of the displayed parameters during crane operation using said sensor arrangement.

2. The mobile crane of claim 1, wherein said program includes instructions for displaying the limits of the operating field by lines having one of different form and color.

3. The mobile crane of claim 1, wherein said program includes instructions for showing the actual value of the displayed parameters during the ongoing crane operation by a crosshair on a graph.

4. The mobile crane of claim 1, wherein said program includes instructions for continuously and automatically indicating the actual value of the displayed parameters during the ongoing crane operation.

5. The mobile crane of claim 1, wherein said program includes instructions for displaying a coordinate graph with the load radius along an ordinate axis and the slewing radius of the counterweight along an abscissa axis.

6. The mobile crane of claim 5, wherein said sensor arrangement includes means for determining the actual adjusted load radius and the slewing radius of said counterweight, said sensor arrangement being connected to said electronic control device of said mobile crane.

7. The mobile crane of claim 5, wherein said program further includes instructions for:

displaying a lower line on said graph indicating a minimum load radius at which said counterweight is safely liftable for an associated counterweight radius value; and displaying an upper line on said graph indicating a maximum load radius at which said counterweight is safely liftable for an associated counterweight radius, whereby a permissible range of adjustment for the counterweight radius for executing slewing movements at a specific load radius is readily discernible by the mobile crane operator.

8. The mobile crane of claim 5, wherein said program includes instructions for showing the actual value of the load radius and the counterweight radius during the ongoing crane operation by a crosshair on the graph.

9. The mobile crane of claim 1, wherein said sensor arrangement is operatively connected for determining the quantity of the load actually suspended at the mobile crane.

10. The mobile crane of claim 1, wherein said program includes instructions for determining the operating field based on a change in load conditions caused by wind force.

11. The mobile crane of claim 10, wherein said sensor arrangement is operatively arranged for determining an effect of wind.

12. The mobile device of claim 10, wherein said electronic control device is operatively arranged for receiving a manually entered value representing a load change caused by wind.

13. The mobile crane of claim 1, wherein said program comprises instructions for switching said electronic control device to a planning mode in which the different load states of said crane are simulated for preparing the operating sequence of a specific lifting task.

14. The mobile crane of claim 13, wherein said program comprises instructions for displaying a graph of the upper limit and lower limit of the permissible load size in the planning mode at a given load radius and a given size of said counterweight depending on the slewing radius of said counterweight.

15. The mobile crane of claim 1, wherein said input device comprises a touchscreen arranged on said display of said electronic control device for data entry and data readout.

16. The mobile crane of claim 1, wherein said program includes instructions for:

displaying a coordinate graph with a first display parameter from the group of display parameters along an ordinate axis and a second display parameter from the group of display parameters along an abscissa axis;

displaying a lower line on said graph indicating a minimum value of the first parameter at which said counterweight is safely liftable for an associated second parameter value; and displaying an upper line on said graph indicating a maximum value of the first parameter at which said counterweight is safely liftable for an associated value of the second parameter, whereby a permissible range of adjustment for the first value at a specific value of the second parameter is readily discernible by the mobile crane operator.

* * * * *